US010507952B2

(12) United States Patent
Zhou

(10) Patent No.: US 10,507,952 B2
(45) Date of Patent: Dec. 17, 2019

(54) THREE-DOOR STORAGE BOX

(71) Applicant: Xinyu Zhou, Portland, OR (US)

(72) Inventor: Xinyu Zhou, Portland, OR (US)

( * ) Notice: Subject to any disclaimer, the term of this patent is extended or adjusted under 35 U.S.C. 154(b) by 0 days.

(21) Appl. No.: 16/045,607

(22) Filed: Jul. 25, 2018

(65) Prior Publication Data

US 2019/0276182 A1 Sep. 12, 2019

(30) Foreign Application Priority Data

Mar. 7, 2018 (CN) ..... 2018 2 0005470 U

(51) Int. Cl.
*B65D 6/24* (2006.01)
*B65D 43/16* (2006.01)

(52) U.S. Cl.
CPC ..... *B65D 11/1893* (2013.01); *B65D 43/163* (2013.01)

(58) Field of Classification Search
CPC .. B65D 11/1893; B65D 43/163; B65D 11/10; B65D 11/1873; B65D 43/0204; B65D 21/0223
USPC ..... 220/692
See application file for complete search history.

(56) References Cited

U.S. PATENT DOCUMENTS 3,987,924 A * 10/1976 Uitz ..... B65D 11/1873 220/4.28
5,028,740 A * 7/1991 Tomiya ..... H05K 9/0073 138/160
5,588,549 A * 12/1996 Furtner ..... B65D 11/1833 220/7
5,967,356 A * 10/1999 Laarhoven ..... B65D 11/1833 220/6
6,145,683 A * 11/2000 Taniguchi ..... H05K 5/0021 220/4.02

* cited by examiner

*Primary Examiner* — Shawn M Braden
(74) *Attorney, Agent, or Firm* — Michael D. Eisenberg

(57) ABSTRACT

A three-door storage box, includes one integrally-formed box body and side frame part. The integrally-formed box body includes the front box panel, the rear box panel, the bottom box panel, the top box panel as well as the buckle panel. The side frame part includes the outer frame, the inner frame, and the frame door. Horizontal and vertical fixed jacks are arranged on the outer frame. Spacer pins are arranged on both upper and lower ends of the outer frame. The storage box can be opened in three directions from left, right and the front to conveniently access the contents in the box. In addition, through installation of fixed jacks and spacer pins, the storage box can be easily assembled/disassembled with all the parts tightly connected, which extends the usage life.

10 Claims, 8 Drawing Sheets

THREE-DOOR STORAGE BOX

CROSS-REFERENCES TO RELATED APPLICATIONS

This application claims priority from Chinese patent application serial number 201820005470.0 filed Mar. 7, 2018, which is hereby incorporated herein by reference in its entirety.

FIELD OF THE INVENTION

The present invention relates to a three-door storage box for household goods.

BACKGROUND OF THE INVENTION

Storage boxes are important for organizing different items in daily life. To ensure easy access and cleanliness, the existing storage boxes generally include a box body and a lid. The box body opens at the top and the lid is closed to the opening. Because of this structure (whether with a separate lid or a flip-open type), once stacked up, it is inconvenient for users to access items stored in a box towards the bottom as they must remove all the boxes on the top.

The present invention provides a three-door type storage box with the functional structure and convenient usage to solve the problems stated above. The box comprises a front box panel, a rear box panel, a bottom box panel, a top box panel, and a buckle panel. Thus, the box can be opened in three directions from left, right and the front which provides easy access to the contents in the lower level storage boxes when stacking up. In addition, through the horizontal fixed jacks/horizontal fixed bolts, vertical fixed jacks/vertical fixed bolts, and then through the spacer pins, the skeleton structure of the storage box can be tightly connected and easy to disassemble, which increases the service life. When stacked up, the convex block and groove will lock the position which helps organizing boxes and increasing the stability. Furthermore, the simple structure of the present invention has the advantage of a lower production cost.

BRIEF SUMMARY OF THE EMBODIMENTS OF THE INVENTION

Figure 1:
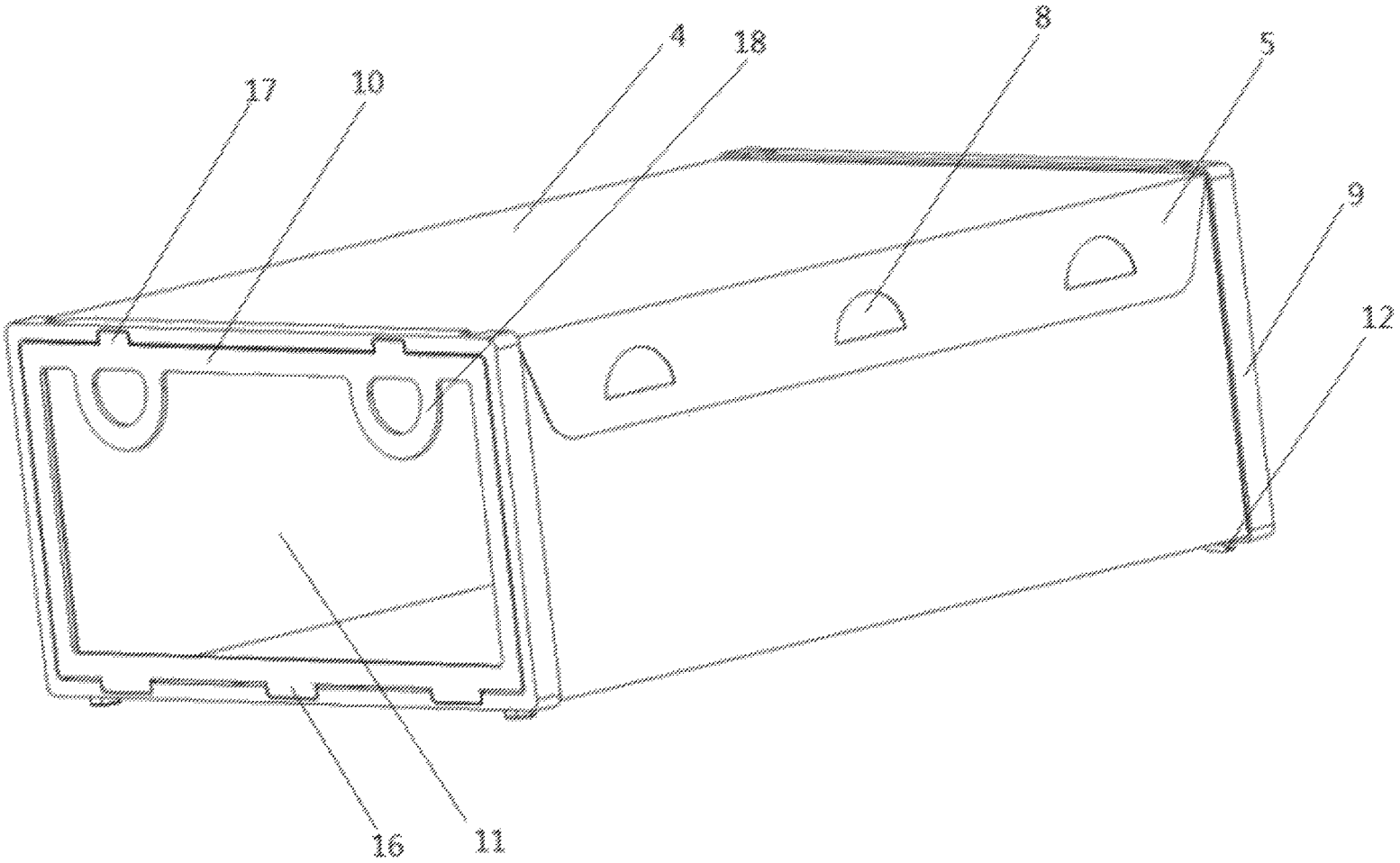
FIG. 1 illustrates a top angled view of the three-door storage box with the doors closed.
Figure 2:
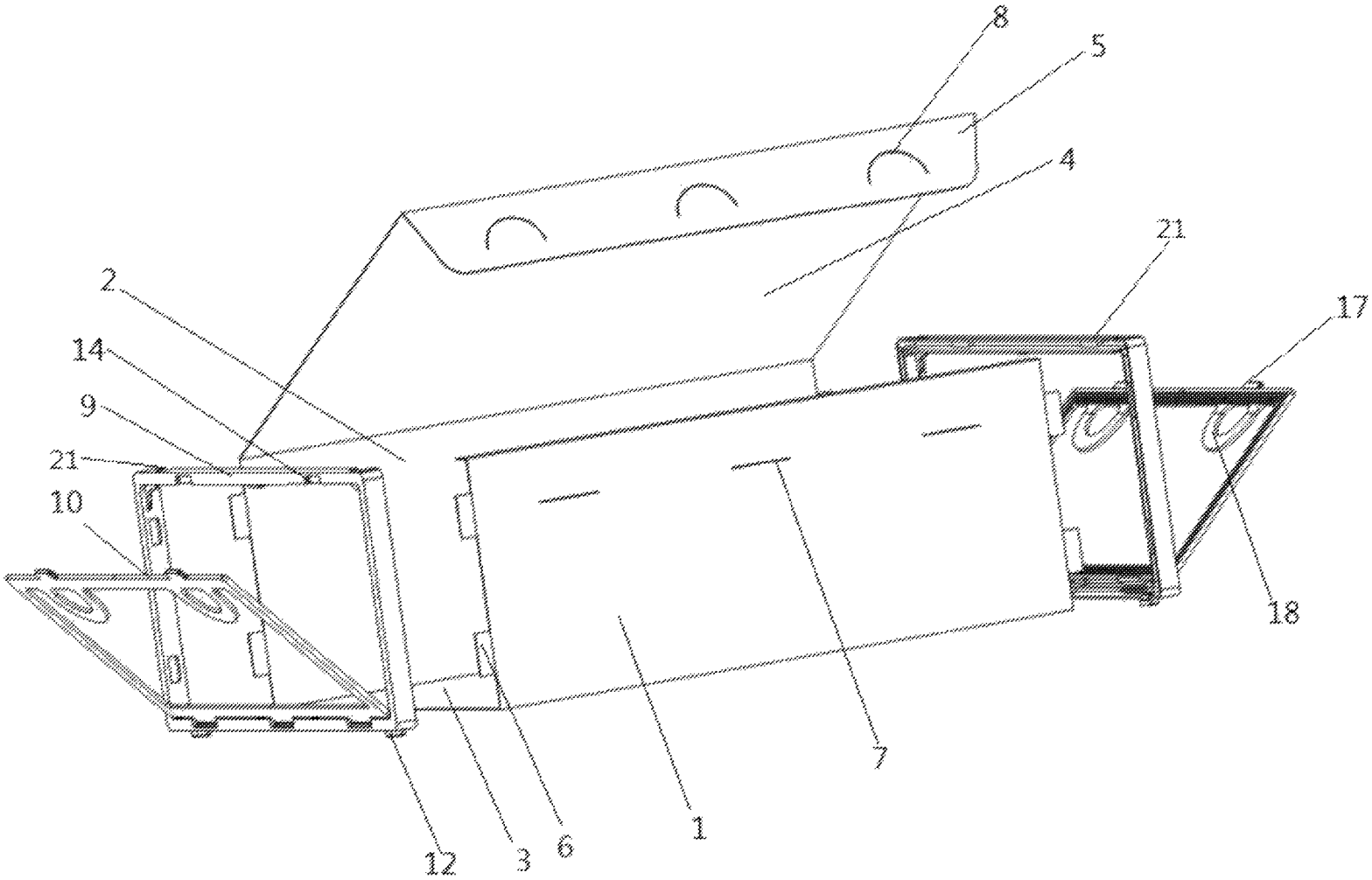
FIG. 2 illustrates a top angled view of the three-door storage box with the doors open.
Figure 3:
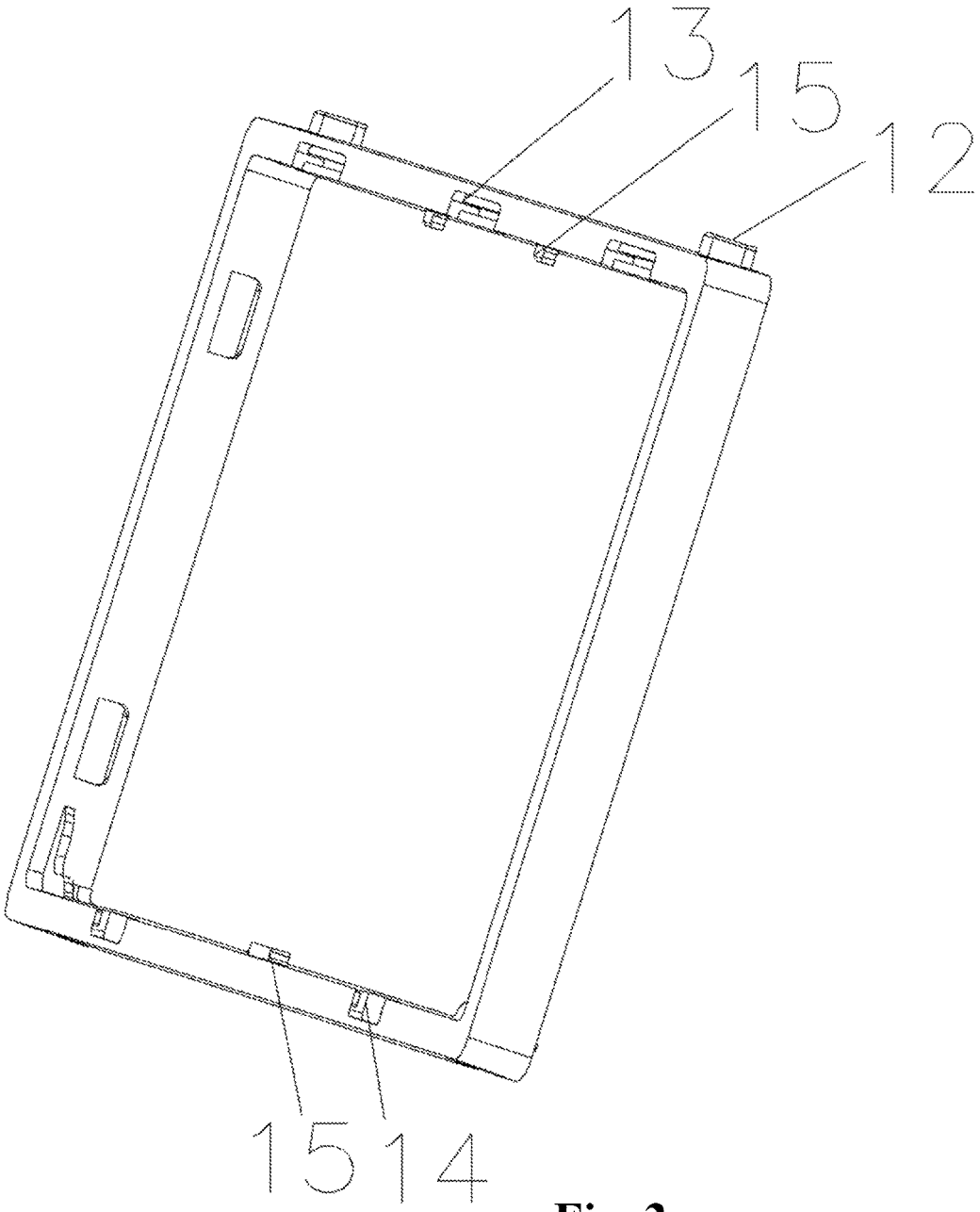
FIG. 3 illustrates an angled front view of the outer frame.
Figure 4:
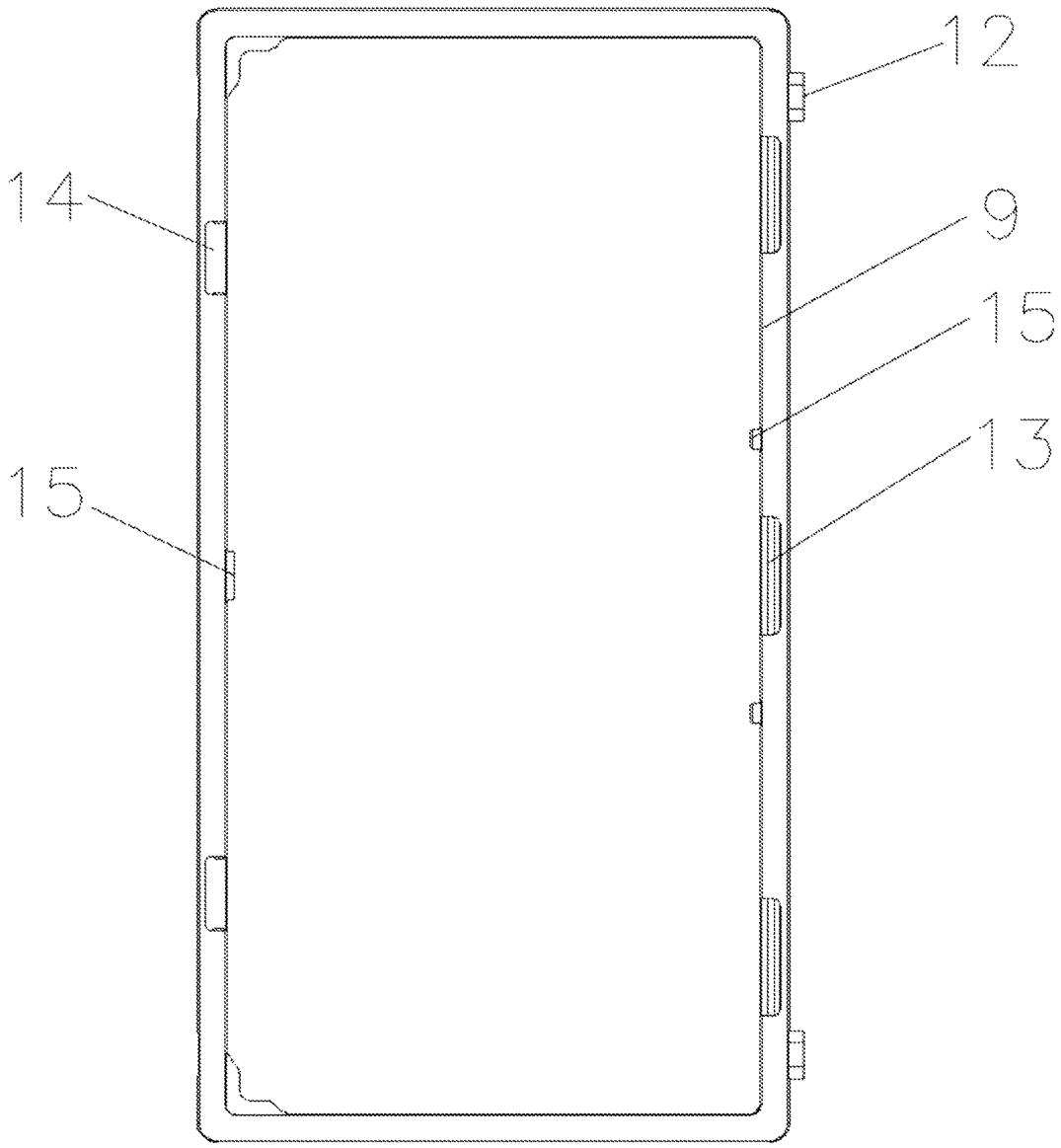
FIG. 4 illustrates a front view of the outer frame.
Figure 5:
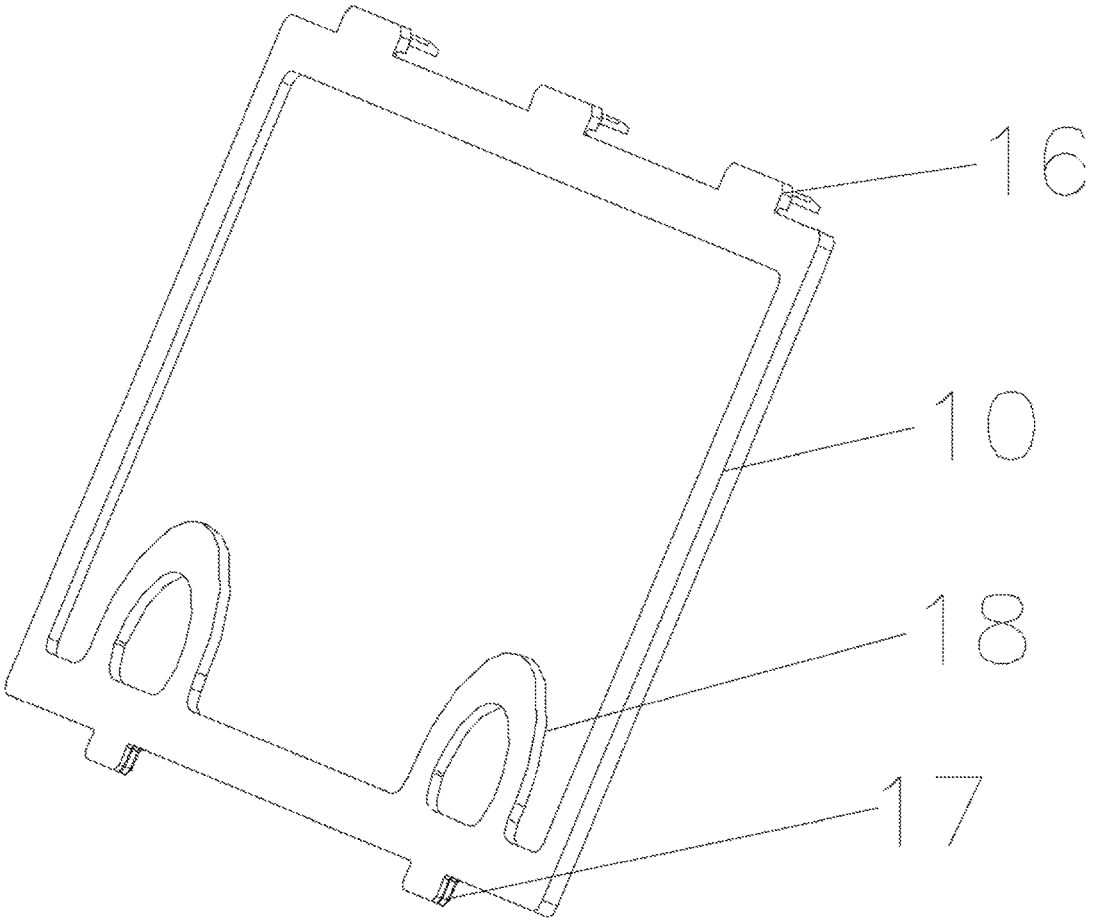
FIG. 5 illustrates an angled front view of the inner frame when the frame door of the box is fixed by the thermoplastic pressure-fit.
Figure 6:
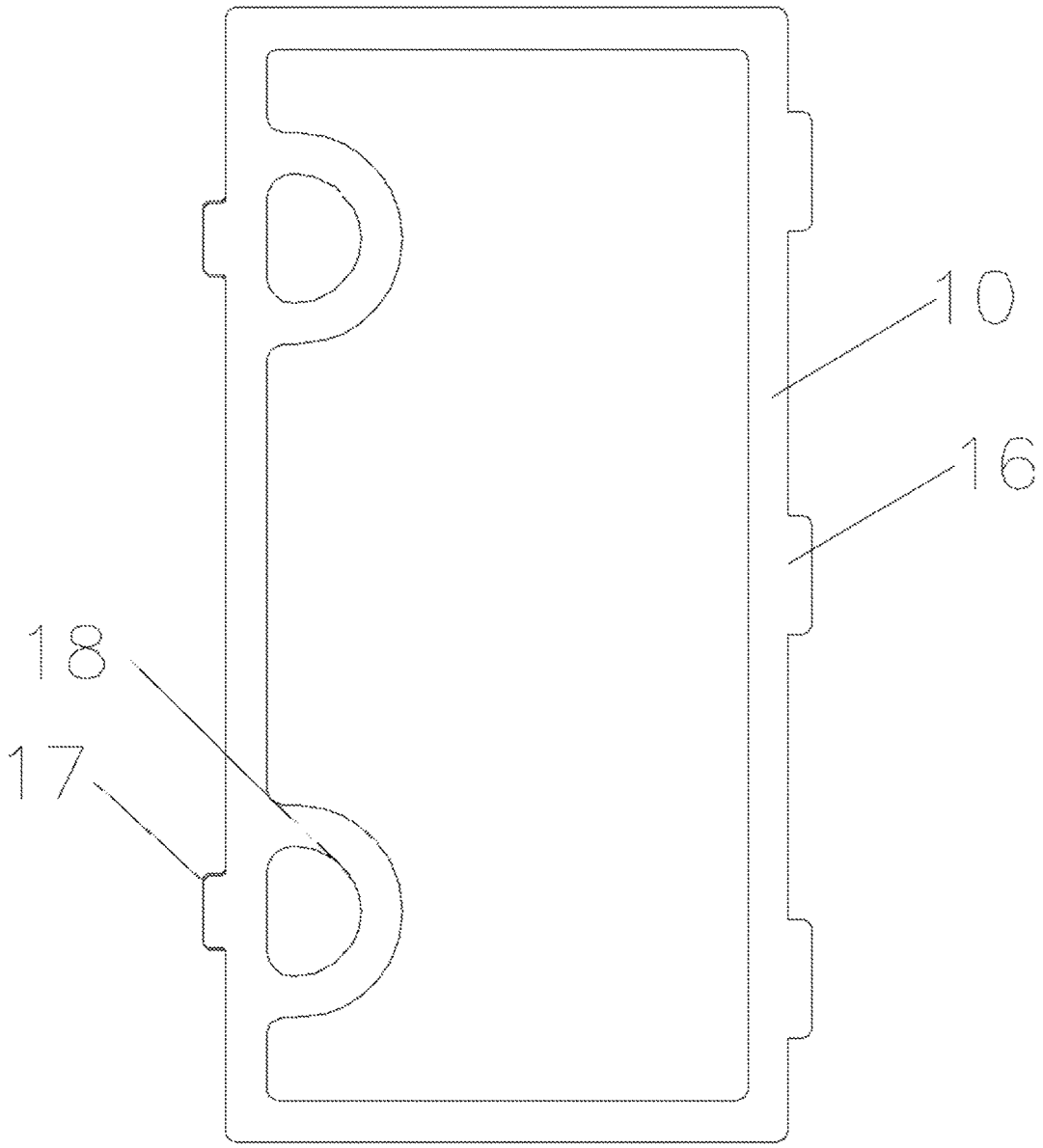
FIG. 6 illustrates a front view of the inner frame when the frame door of the box is fixed by the thermoplastic pressure-fit.

In a variant, a storage box, comprises a body having six faces. The box has a first side frame and an opposing second side frame, with each side frame having an outer frame, an inner frame, and a frame door. The storage box has a front panel having a plurality of slits. The box has a rear panel and a bottom panel. A top panel is configured to attach to a buckle panel having a plurality of locking tabs configured to be received by the slits. A first side and an opposing second side of the front panel has a plurality of fixed pins and a first side and an opposing second side of the rear panel has a plurality of fixed pins, the pins being configured to secure an outer edge of the body into a mounting groove. The outer frame has a plurality of fixed jacks configured to correspond to a plurality of fixed bolts on the inner frame. Fixed bolts are configured to loosen and the frame door and inner frame are configured to separate from the outer door when the frame doors open.

In another variant, the frame door has a plurality of riveting holes configured to receive a plurality of riveting fasteners on the inner frame.

In a further variant, a plurality of riveting clasps are configured to secure the frame door onto the inner frame.

In yet another variant, each locking tab has a semi-circular shape.

In another variant, a bottom of the outer frame has three horizontal fixed jacks and a top of the outer frame has two vertical fixed jacks.

In a further variant, a bottom of the inner frame has three horizontal fixed bolts, configured to attach to the horizontal jacks on the outer frame, and two vertical fixed bolts, configured to attach to the vertical jacks on the outer frame.

In yet another variant, the outer frame has a plurality of spacer pins.

In another variant, the inner frame has handles disposed below the vertical fixed bolts.

In a further variant, a top of an outer frame of a first box has a plurality of grooves configured to receive a plurality of convex blocks on a bottom of an outer frame of a second box disposed above the first box.

In yet another variant, the frame door is configured to be hot-pressed onto the inner frame.

DETAILED DESCRIPTION OF THE EMBODIMENTS OF THE INVENTION

The following reference numbers are used throughout the description to refer to elements in the figures:

1 Front panel
2 Rear panel
3 Bottom panel
4 Top panel
5 Buckle panel
6 Fixed pins
7 Slits
8 Locking tabs
9 Outer frame
10 Inner frame
11 Frame door
12 Convex blocks
13 Horizontal fixed jacks
14 Vertical fixed jacks
15 Spacer pins
16 Horizontal fixed bolts
17 Vertical fixed bolts
18 Handle
19 Riveting clasp
20 Riveting fastener
21 Grooves In a variant, referring generally to FIGS. 1-8, a three-door type storage box comprises an integrally-formed box body with six faces and a side frame part. The integrally-formed box body comprises the front box panel 1, the rear box panel 2, the bottom box panel 3, the top box panel 4 as well as the buckle panel 5. Two first fixed pins 6 are arranged on both left and right sides of the front box panel 1 and the rear box panel 2. The front box panel 1 has three line-type slots 7. The buckle panel 5 has three semi-circular locking tabs 8 corresponding to the line-type slots 7, which establish a hatchback opening and closing. The side frame part includes the outer frame 9, the inner frame 10 and the frame door 11. The outer frame 9 has a mounting groove.

In another variant, referring to FIGS. 2-6, during assembly, the outer edge of the integrally-formed box body is inserted into the mounting groove and locked by the first fixed pins 6. At the bottom of the outer frame 9, there are three horizontal fixed jacks 13. At the top of the outer frame 9, there are two vertical fixed jacks 14. The upper and lower ends of the outer frame 9 are provided with spacer pins 15. The spacer pins 15 restrict the position of the outer frame 9 and the inner frame 10 and prevent the inner frame 10 being pushed too far during installation.

There are two convex blocks 12 set at the bottom of the outer frame 9, corresponding to the grooves 21 set at the top of the outer frame 9. When multiple three-door type storage boxes are stacked, the convex blocks 12 of the box above can be placed in the grooves 21 of the box below to prevent the boxes from moving around and place boxes more neatly. The inner frame 10 has three horizontal fixed bolts 16 at the lower end, corresponding to the horizontal fixed jacks 13, and two vertical fixed bolts 17 at the upper end, corresponding to the vertical fixed jacks 14. Handles 18 are set below the vertical fixed bolts 17. The handle 18 is a circular ring. To open the door 11 from both sides, the handle 18 is pulled outward to loosen the horizontal fixed bolts 16 and the vertical fixed bolts 17. The frame door 11 and the inner frame 10 will then leave the outer frame 9.

Figure 7:
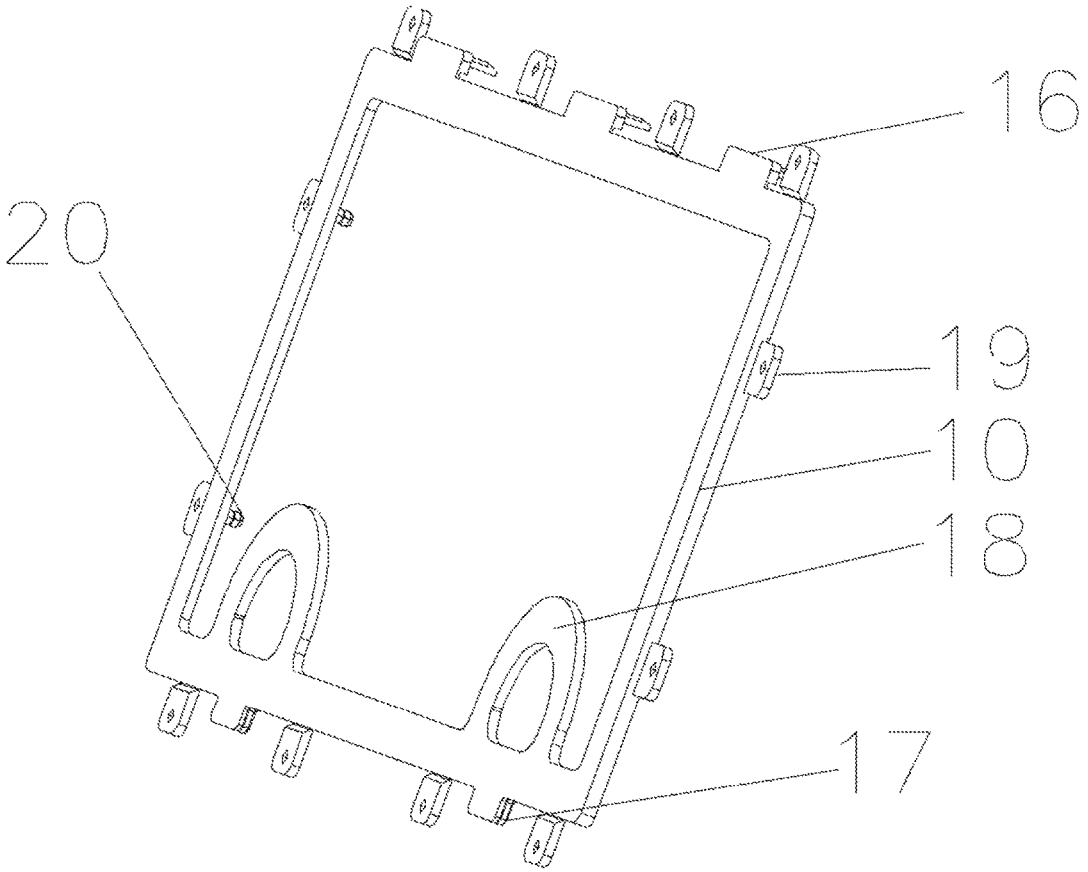
FIG. 7 illustrates an angled front view of the inner frame when the riveting device fixes the frame door of the box to the inner frame.
Figure 8:
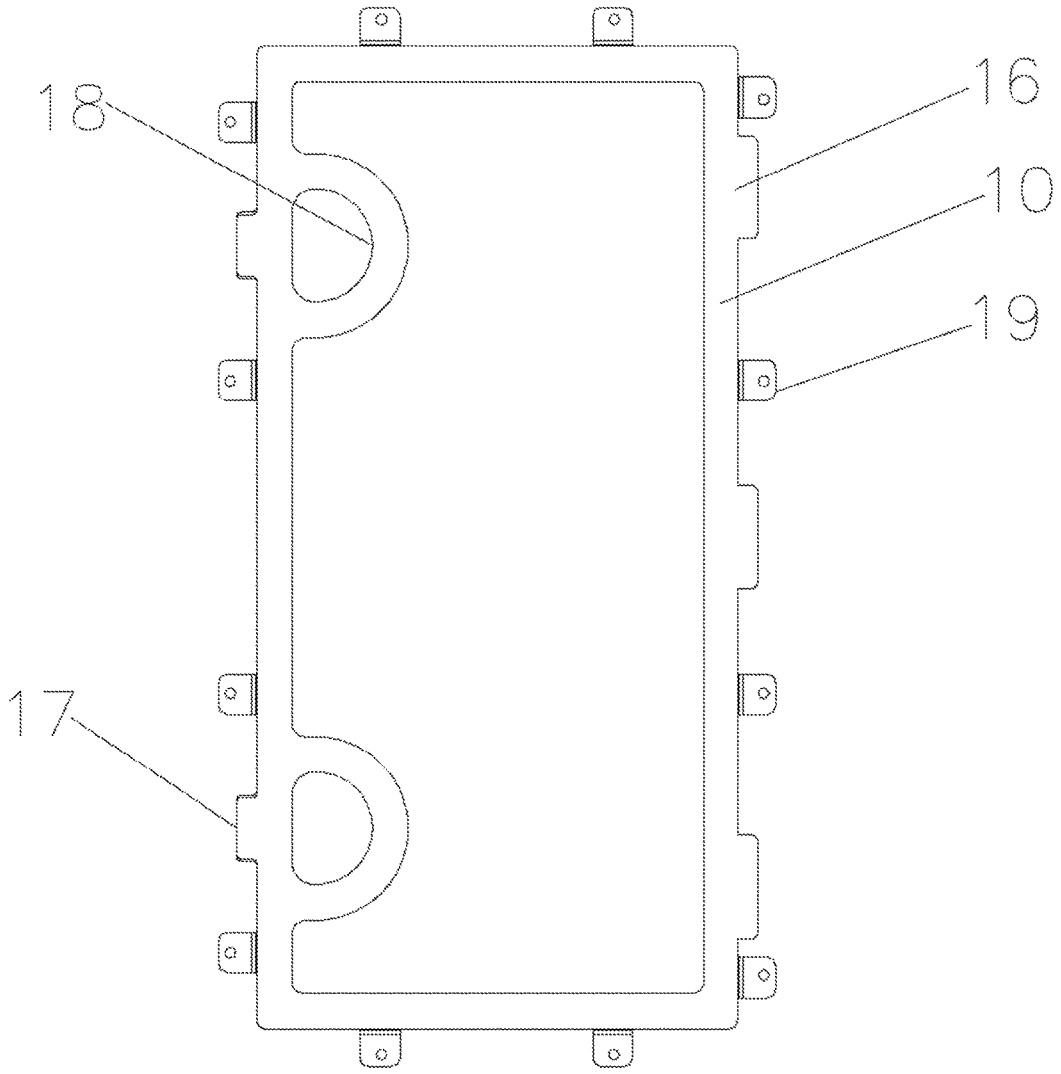
FIG. 8 illustrates a front view of the inner frame when the riveting device fixes the frame door of the box to the inner frame.

In a further variant, referring to FIGS. 7-8, the frame door 11 is fixed on the inner frame 10 by a riveting device. The riveting device includes a loose-leaf riveting clasp 19 and a riveting fastener 20. The frame door 11 is provided with riveting holes to let the riveting fasteners 20 on the inner frame 10 pass through. Then the loose-leaf riveting clasps 19 lock the frame door 11 on the inner frame 10.

In yet another variant, the frame door 11 is hot-pressed on the inner frame 10.

What is claimed is:

1. A storage box, comprising:

a body having six faces;

a first side frame and an opposing second side frame, each side frame having an outer frame, an inner frame, and a frame door;

a front panel having a plurality of slits;

a rear panel;

a bottom panel;

a top panel configured to attach to a buckle panel having a plurality of locking tabs configured to be received by the slits;

wherein a first side and an opposing second side of the front panel have a plurality of fixed pins and a first side and an opposing second side of the rear panel have a plurality of fixed pins, the pins being configured to secure an outer edge of the body into a mounting groove disposed on the outer frame;

wherein the outer frame has a plurality of fixed jacks configured to correspond to a plurality of fixed bolts on the inner frame; and wherein the fixed bolts are configured to loosen and the frame door and inner frame are configured to separate from the outer door when the frame doors open.

2. The box of claim 1, wherein the frame door has a plurality of riveting holes configured to receive a plurality of riveting fasteners on the inner frame.

3. The box of claim 2, wherein a plurality of riveting clasps are configured to secure the frame door onto the inner frame.

4. The box of claim 1, wherein each locking tab has a semi-circular shape.

5. The box of claim 1, wherein a bottom of the outer frame has three horizontal fixed jacks and a top of the outer frame has two vertical fixed jacks.

6. The box of claim 5, wherein a bottom of the inner frame has three horizontal fixed bolts, configured to attach to the horizontal jacks on the outer frame, and two vertical fixed bolts, configured to attach to the vertical jacks on the outer frame.

7. The box of claim 1, wherein the outer frame has a plurality of spacer pins.

8. The box of claim 1, wherein the inner frame has handles disposed below the vertical fixed bolts.

9. The box of claim 1, wherein a top of an outer frame of a first box has a plurality of grooves configured to receive a plurality of convex blocks on a bottom of an outer frame of a second box disposed above the first box.

10. The box of claim 2, wherein the frame door is configured to be hot-pressed onto the inner frame.

* * * * *